US006270049B1

(12) United States Patent
Olvey

(10) Patent No.: US 6,270,049 B1
(45) Date of Patent: Aug. 7, 2001

(54) TABLETOP EASEL WITH PAGE RETENTION

(76) Inventor: Douglas A. Olvey, 1300 Suzanne Way, Longwood, FL (US) 32779

( * ) Notice: Subject to any disclaimer, the term of this patent is extended or adjusted under 35 U.S.C. 154(b) by 0 days.

(21) Appl. No.: 09/306,703

(22) Filed: May 7, 1999

(51) Int. Cl.[7] ..... A47B 19/00; A47B 23/00; A47B 97/04

(52) U.S. Cl. ..... 248/441.1; 248/444; 248/445; 248/447; 248/454; 248/457; 248/460; 248/461

(58) Field of Search ..... 248/441.1, 444, 248/445, 447, 454, 457, 460, 461, 462; 40/120, 158, 356

(56) References Cited

U.S. PATENT DOCUMENTS

| | | | | |
|---|---|---|---|---|
| 2,091,260 | * | 8/1937 | Farkas et al. | 40/158 |
| 2,490,356 | * | 12/1949 | Hummel | 45/57 |
| 3,097,444 | * | 7/1963 | Steiner | 45/57 |
| 3,195,850 | * | 7/1965 | Steiner | 248/454 |
| 3,981,522 | | 9/1976 | Bloom | 281/34 |
| 4,044,980 | | 8/1977 | Cummins | 248/13 |
| 4,400,161 | * | 8/1983 | Gerlt | 434/104 |
| 4,544,123 | * | 10/1985 | Peacock | 248/460 |
| 4,607,817 | | 8/1986 | Aquino | 248/459 |
| 4,709,895 | * | 12/1987 | Mardak | 248/460 |
| 4,722,504 | * | 2/1988 | Degenholtz | 248/459 |
| 5,080,316 | * | 1/1992 | MacEwan | 248/459 |
| 5,230,535 | * | 7/1993 | Figlenski | 248/441.1 |
| 5,413,305 | * | 5/1995 | Leeb | 248/460 |
| 5,480,118 | * | 1/1996 | Cross | 248/459 |
| 5,722,628 | * | 3/1998 | Menaged | 248/441.1 |
| 5,755,423 | | 5/1998 | Michela | 248/459 |
| 5,868,373 | | 2/1999 | Duff | 248/459 |

* cited by examiner

*Primary Examiner*—Leslie A. Braun
*Assistant Examiner*—A. Joseph Wujciak
(74) *Attorney, Agent, or Firm*—Julian C. Renfro, Esq.

(57) ABSTRACT

An easel or book stand for the support of a book or booklet utilizing front and rear panels movable into a spread-apart relationship. An elongate base member attached between the lower edges of the panels includes a first flexible elongate component hingedly connected along the lower edge of the front panel as well as to a second elongate component. The second elongate component has a slightly greater width than the first elongate component, and through an intermediate base member, has a connection with the lower edge of the rear panel. The front panel, when its lower edge is moved a bit rearwardly from its spread-apart relationship with the rear panel, causes the first and second elongate components to move into an adjacent, substantially coplanar relationship. The first and second elongate components are together rotatable between an outwardly-extending, book-receiving position along the lower edge of the front panel, and an upward position in which the elongate components are in essential parallelism with the front panel. The first elongate component, being of lesser width than the second elongate component, serves as some support for the lower edge of the front panel during such upward rotation of the elongate components, with the portion of the weight of the front panel borne by the first elongate component contributing to the development of an automatic bias holding the second elongate component in firm contact with the lower edge of a book residing adjacent the front panel.

47 Claims, 5 Drawing Sheets

FIG 1
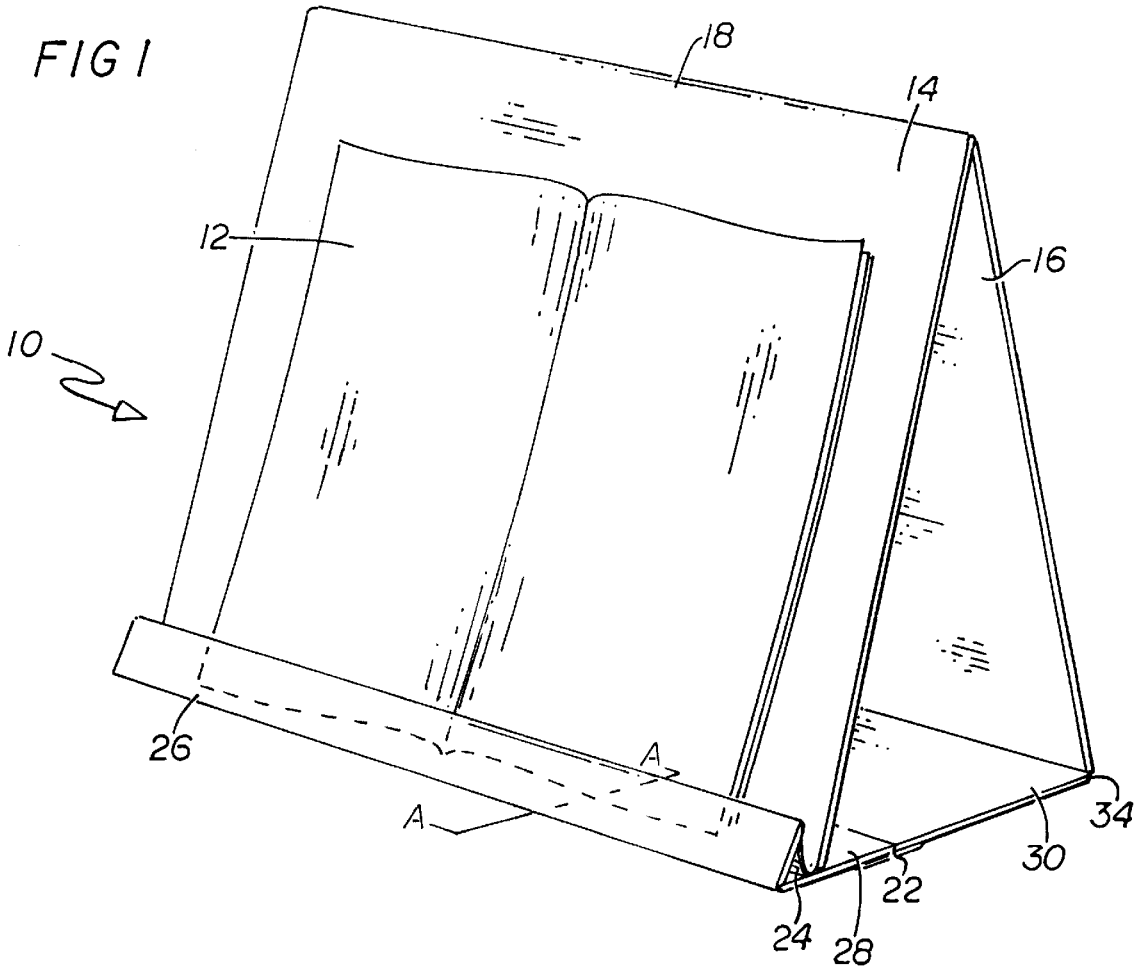
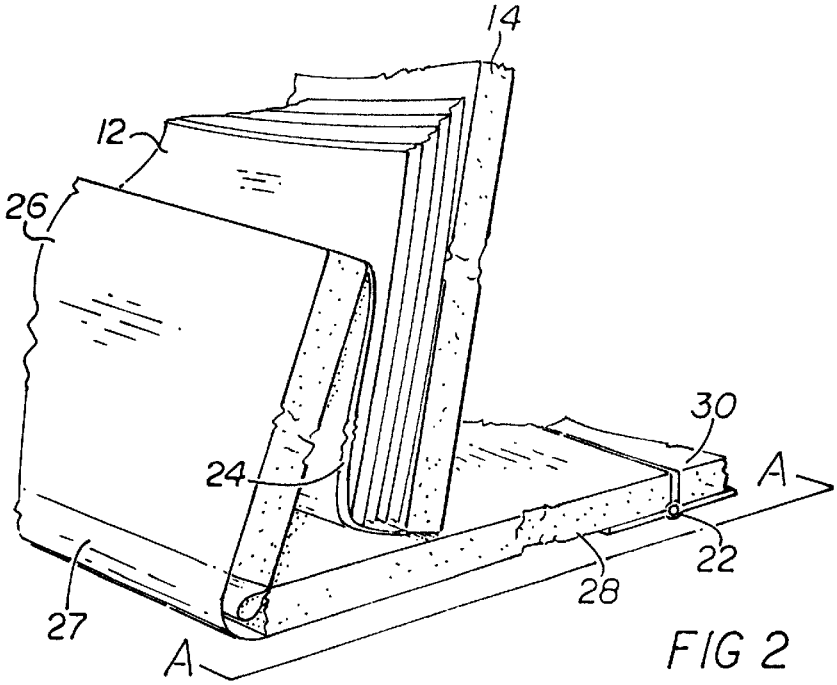
FIG 2

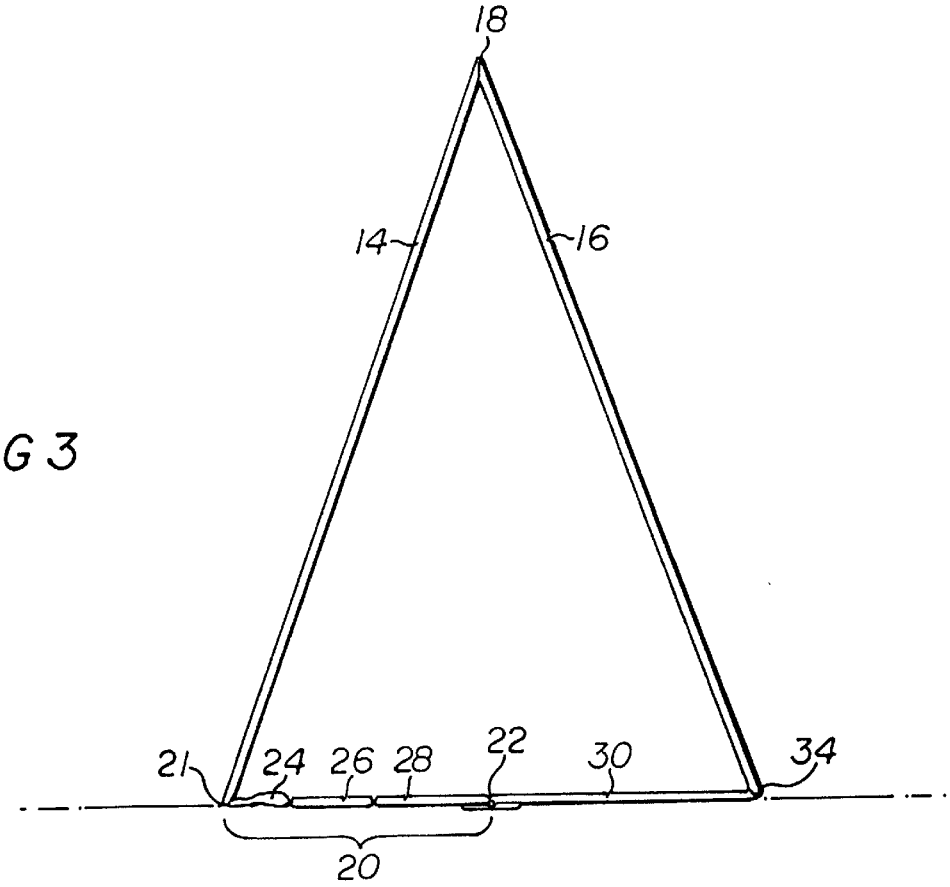
FIG 3
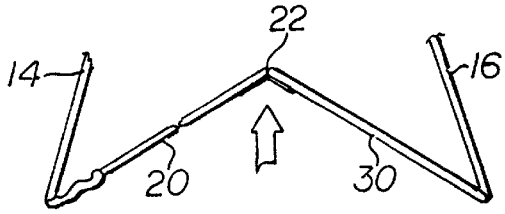
FIG 3a
FIG 3b
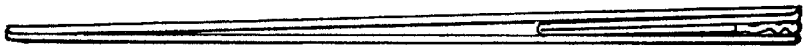
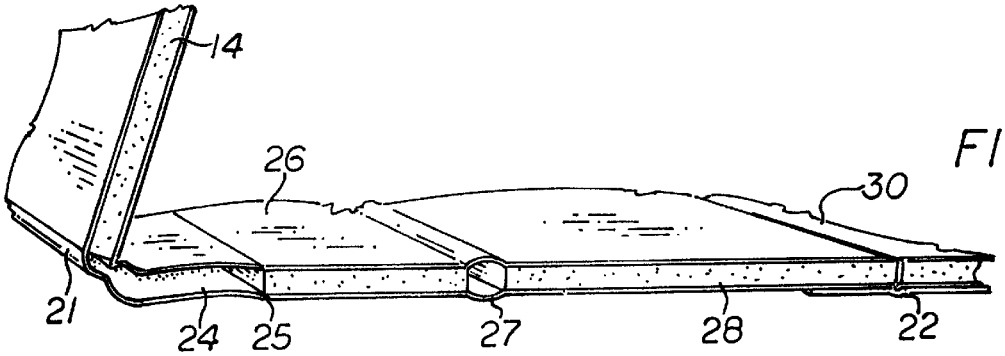
FIG 4

TABLETOP EASEL WITH PAGE RETENTION

BACKGROUND OF THE INVENTION

For many generations now is has been customary during lectures and presentations to resort to the use of books, booklets, posters and the like in order to explain to a classroom or to an audience, certain diagrams, pictures, graphs, charts or other devices serving to make the presentation more easily understood, or to help hold the attention of the audience. In many instances of this type, it has been customary to utilize an easel, made up of a slightly inclined front surface, at the bottom of which is a small ledge or shelf upon which the book, booklet, poster or other item can be held in a slightly rearwardly inclined attitude.

Most unfortunately, when a book or booklet is resting against the front surface of the typical easel, the pages of the book tend to sag or droop in such a manner as not to be easily read by the persons in the audience. Consequently, it has been customary to utilize certain means for holding the pages in a relatively flat condition, which means can take the form of a small clip or clamp utilized on the right and left edges of the book in order to keep the pages in a readily readable attitude. Another option may include the use of a fairly long elastic strap used to encircle the easel and the book, with such strap serving to hold the pages flat.

As a consequence of the use of devices of this type, it becomes fairly burdensome for the teacher or lecturer to turn the pages of the book for as is obvious, it is necessary to remove the clips or clamps, or the encircling strap before the page can be turned, after which the clips, clamps or encircling strap must be restored to the page-retaining positions.

The Bloom U.S. Pat. No. 3,981,522 entitled "Book Holder" exemplifies the type of device requiring the use of an encircling band in holding the pages of a book in an open position.

The Cummins U.S. Pat. No. 4,044,980 entitled "Collapsible Desktop Stand for Portable Electronic Calculator" represents a device that could be used for holding a book as well as a calculator, but this patent contains no teaching of an arrangement for holding the pages of a book or booklet in an open, easily read position.

The Aquino U.S. Pat. No. 4,607,817 entitled "Collapsible Podium" involves a display device having front and rear panels in a hinged relationship to a floor panel, with a lip structure provided for supporting a book adjacent the front panel. However, this patent is entirely silent as to any capability of such lip structure providing an automatically functioning bias arrangement for holding the pages of the book in a flattened, easy to read position.

The MacEwan U.S. Pat. No. 5,080,316 entitled "Portable Viewing Stand" pertains to a device involving several multifolded components, requiring careful assembly and entirely failing to teach a book-supporting component biased automatically into a relationship in which the pages of the book are held in an easily read position.

The Leeb U.S. Pat. No. 5,413,305 entitled "Lightweight Collapsible Book Stand" teaches the use of a device having a relatively strong cellophane or transparent plastic strip secured to the front panel of the device. This patentee specifies that if his book stand is used with a thin book or magazine, the book or magazine may be read through the transparent means. This, however, is a far cry from a retaining lip automatically biased into a position in which the pages of a book are maintained flat for easy reading.

The Menaged U.S. Pat. No. 5,722,628 entitled "Collapsible Variable Position Reading Stand" teaches a device involving a frontal panel and a rear panel, with it being readily possible to alter the angular positions of the frontal panel with respect to a book-engaging support lip. Although this patent permits a range of adjusted positions for the convenience of the reader, this patent, also, is silent as to any capability of the support lip utilizing an automatically functioning bias arrangement for holding the pages of a book in a flattened, easily read position.

The Michela U.S. Pat. No. 5,755,423 entitled "Folding Portable Support Stand" requires a substantial amount of assembly time, and quite importantly, this patentee provides no teaching of an arrangement for reliably holding the pages of a book in an open, easily read position, and thereafter readily permitting the user to turn the page of the displayed book or booklet without having to remove an encircling band or release a clip.

Although it is obviously well known to provide a ledge or shoulder on an easel or support stand, the prior art has not taught an arrangement for keeping the pages from turning unintentionally, due for example to a draft. Furthermore, the prior art has not taught an arrangement for permitting the teacher or lecturer to deliberately and easily turn the page of the displayed book without first having to remove a clip, clamp or encircling band, and to thereafter avoid having to reapply such device when the page turning has been completed.

It was in an effort to overcome the distinct disadvantages of prior art devices of these and other types that the present invention was evolved.

SUMMARY OF THE INVENTION

In accordance with this invention I have provided a novel easel or reading stand primarily for tabletop use, which utilizes front and rear panels whose upper edges are joined together in the manner of a flexible hinge. In the primary embodiment, each of these front and rear panels extends the full length or lateral dimension of the easel and are readily movable from a folded condition into a relationship in which the lower edges of the front and rear panels assume a spread apart, outward position.

The lower edges of the front and rear panels are interconnected by multiple, folded base members, with the base member attached to the front panel being constituted by hingedly interconnected, multiple elongate components, each of which extends substantially the full length of the easel. In the primary embodiment the first elongate component is of flexible construction, whereas the second elongate component is of relatively stiff construction, and is deliberately of a somewhat greater width than the first elongate component. The front panel, when its lower edge is moved a bit rearwardly from its most outward position, causes the first and second elongate components to move into an adjacent, substantially coplanar relationship, such that the first elongate component is located above the second elongate component and positioned along the lower edge of the front panel. In this instance the first and second elongate components are in an outwardly-extending, book-receiving position forming a ledge for receiving the lower edge of a book, booklet or poster to be placed against the front panel of the easel.

The first and second elongate components are rotatable between the outwardly-extending, book-receiving position, and an upward position in which the elongate components are automatically biased into essential parallelism with the front panel. The first elongate component, by being of lesser width than the second elongate component, serves as some support for the lower edge of the front panel during such upward rotation of the elongate components, with the portion of the weight of the front panel borne by the first elongate component developing the bias tending to hold the second elongate component in a firm restraining contact with the lower edge of a book, booklet or poster residing adjacent the front panel.

Inasmuch as the first elongate component in the primary embodiment is of flexible construction and subject to being deflected somewhat downwardly by the weight of a book or poster placed thereon at such time as the book, booklet or poster is in contact with the front panel, it plays a role in causing the pages of a book or booklet to be firmly retained in a position such that they are easily read by an audience or the students in a classroom. Because of the inherent novel construction of my easel, the first and second elongate components thus serve in a highly advantageous and unobvious manner to hold the pages of an opened book in a flattened, easy-to-read condition, thus making quite unnecessary, any of the previously known techniques frequently used for this purpose, such as clips used on the right and left edges of prior art easels in order to keep the pages in a flat and easily read manner, or an encircling band.

Entirely obviated by the novel design in accordance with this invention is the need for the use of springs, magnets or any other metallic device for causing the first and second elongate components to reside in a position firmly holding the pages of the open book in an easily read condition.

It is therefore a principal object of my invention to provide a lightweight easel of inexpensive construction which, by virtue of its highly advantageous and unobvious design, enables the pages of a book or booklet to be automatically held in a non-slip, easily read position, with no external restraint means being required for holding the pages of the book or booklet in a fully open attitude.

It is another object of my invention to provide a lightweight easel constructed, for example, of a suitable combination of plastic components or plastic components combined with cardboard, with the inherent and highly advantageous configuration of certain of the components located along a lowermost part of my novel easel serving to automatically hold the pages of a book or booklet in a flattened, easily read manner, with this being accomplished without the use of clips, clamps or encircling bands.

It is still another object of my invention to provide a lightweight easel that when unfolded forms an improved ledge or shoulder for supporting a book, booklet or other such item on the front of the easel, with this novel ledge or shoulder being constructed so as to rotated upwardly into a position in which it inherently and automatically biased into a firm, page-retaining position in which it contacts the pages of the book or booklet.

It is yet another object of my invention to provide a lightweight, low cost easel having as an intrinsic part of its construction, an improved ledge or shoulder for supporting a book, booklet or other such item adjacent the front panel of the easel, with this novel ledge or page-restraint device being readily moved from an outwardly extending position into an upwardly folded position, with this ledge or page-restraint device being inherently biased into the upward, page-retaining position while still thereafter readily permitting an intentional movement of this ledge away from the page-retaining position to permit the pages of the book or booklet to be turned.

It is yet still another object of my invention to provide an easel for the support of a book or booklet in which a pair of foldable components mounted along the lower edge of the front panel of an easel are easily rotatable from an outwardly extending, book-receiving position into an upwardly directed position in which these elongate components are automatically biased into a position retaining the pages of the book or booklet in flattened, easily read positions, but with these components being temporarily movable out of the page-retaining position to permit the page to be turned, after which they may be readily returned to the page-retaining position.

It is yet still another object of my invention to provide a lightweight, collapsible easel having as an intrinsic part of its construction, an improved ledge or page-restraint device for supporting a book, booklet or other such item adjacent the front panel of the easel, with this novel ledge or page-restraint device being inherently biased into an upwardly folded position, where it remains in a page-retaining position irrespective of the weight of a book or booklet supported on the ledge or shoulder.

It is yet still another object of my invention to provide a lightweight, collapsible easel that may be created by extrusion techniques, with the inherent configuration of certain components of this novel easel serving to automatically hold the pages of a book in an easily read condition.

It is yet still another object of my invention to provide a lightweight easel of inexpensive construction, which can be carried in a flat, easily transported condition, and then readily converted, without the use of any tools or necessitating an assembly procedure, into a highly satisfactory easel designed to support an opened book or booklet in such a manner that the pages of the book or booklet will not sag, but rather will be automatically maintained in an easily read condition, with no external means such as clips or encircling bands being required for this purpose.

These and other objects, features and advantages will become more apparent as the description proceeds.

BRIEF DESCRIPTION OF DRAWINGS

FIG. 1 is a perspective view from a front corner of a primary embodiment of my novel easel, showing how the pages of a book resting adjacent the front panel of the easel can be automatically retained in a flat, easy-to-view condition by the inherent and unobvious action of a lower front component of my novel easel;

FIG. 2 is a fragmentary view to a substantially larger scale than FIG. 1, revealing that the weight of a book or booklet resting upon a flexible member of the lower front component of my easel causes some deflection of the flexible member;

FIG. 3 is an edge or end view of my novel easel, showing how a pair of base members prevent the front and back panels of the easel from moving further apart than a desired extent;

FIG. 3*a* is a view bearing some relationship to FIG. 3, and showing how the hinged together base members can be moved upwardly during the procedure of converting the easel into its folded condition;

FIG. 3*b* is a view of the easel in a fully folded condition;

FIG. 4 is a relatively large scale fragmentary view generally relatable to the lower portion of the embodiment of my easel depicted in FIGS. 1 and 2, with this view revealing that the hinge existing between a pair of the elongate base members is formed of the upper and lower plastic or paper sheets with which the relatively rigid elongate base components are covered;

DETAILED DESCRIPTION

Figure 5:
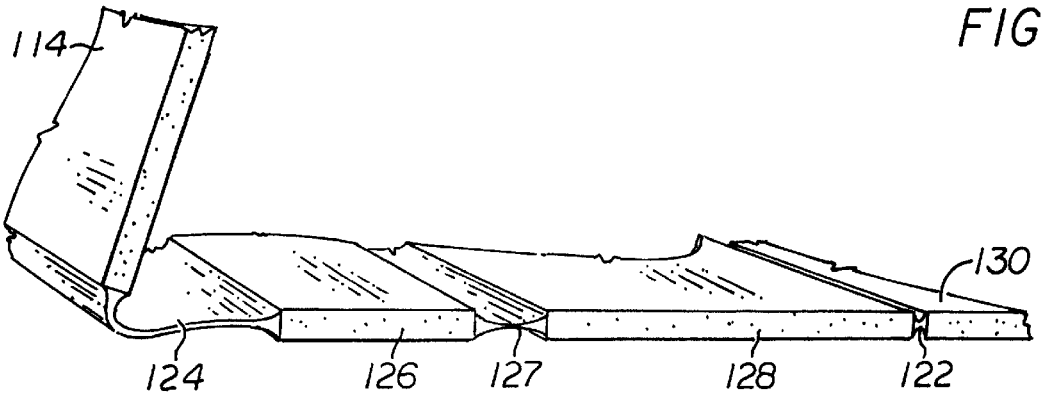
FIG. 5 is a fragmentary view bearing a definite similarity to FIG. 4, but with the hinges in accordance with this embodiment of my invention being formed during a procedure in which the base members and the front and rear panels of my easel are created during an extrusion process.

With initial reference to FIG. 1, it will be seen that I have there shown a primary embodiment of my novel folding easel 10 in its deployed or operative position, with a relatively thin book or booklet 12 supported thereon. As will be described in detail hereinafter, my easel is primarily designed for tabletop use, and advantageously serves to hold the book, booklet, or even a poster in a stable, no slip relationship. In the event that the supported object is a book or booklet, the design of my novel easel is such that, as a result of the inherent, unobvious and highly advantageous operation of my device, the pages of the book or booklet will be held in fully open, easily viewed positions without the use of any additional devices or hardware.

The easel 10 is principally constructed of flat, generally planar components, involving a front panel 14 and a rear panel 16, with these two panels typically being of substantially equal size and with each of these panels extending the full length or lateral dimension of the easel. However, in some instances the rear panel 16 can have less length than the front panel inasmuch as the rear panel is not used in supporting a book, booklet, poster or large photograph, in the manner that the front panel is employed.

Importantly, in the preferred embodiment of my invention, the upper edges of the front panel 14 and rear panel 16 are joined together at 18 in the manner of a flexible hinge. This arrangement permits the front and rear panels to be movable between the flattened, touching relationship depicted in FIG. 3*b*, and a relationship in which the lower edges of the front and rear panels are separated into a fully spread apart, stable position as depicted in FIG. 3. A discrete hinge component, as such, may be used at 18 at the top of the panels 14 and 16, but several alternatives are available, as will be discussed hereinafter.

In FIG. 1 I reveal how a book or booklet 12 resides against the front panel 14, with its pages held open to a desired location by the inherent and unobvious configuration of the novel page-retainer or front lip 26. This front lip, also hereinafter referred to as a relatively rigid, elongate component, is able to be moved so as to extend along a lowermost front part of my novel easel. As will later be explained, the front lip 26 is an integral part of an automatically functioning, novel bias arrangement, in accordance with which it serves to retain the pages of a book or booklet in a flattened, easily read manner. Significantly, this retention of the book or booklet in such desired manner is accomplished without the use of clips, clamps or encircling bands.

In FIG. 2 I show to a substantially enlarged scale, how the automatically functioning bias arrangement associated with the front lip or elongate component 26 is achieved by its novel interaction with an elongate member 24 that is attached to the lower edge of the front panel 14. In the preferred embodiment illustrated in this figure, the elongate member is of flexible construction, and this highly advantageous and entirely unobvious arrangement will shortly be discussed in detail.

Before discussing FIGS. 1 and 2 at greater length, however, it should be noted in FIG. 3 that I show the easel 10 spread to its fullest width, before it has been moved into the position or condition in which a book or booklet can be supported in a close relationship to the front panel 14. It can be seen from FIG. 3 that the lower edges of the front and rear panels 14 and 16 are interconnected by multiple, folded base members, including an elongate front base member 20 and an elongate rear base member 30. It is to be noted that the rear edge of the rear base member 30 is hingedly attached at 34 to the lower edge of the rear panel 16, whereas the front edge of the front base member 20 is hingedly attached at 21 to the lower edge of the front panel 14. As should be apparent, the separation or spread of the bottom edges of the front and rear panels 14 and 16 at the time the easel is moved into the initial deployed position depicted in FIG. 3 is limited by the functioning of the hingedly interconnected base members 20 and 30.

In accordance with the embodiment revealed to a somewhat larger scale in fragmentary FIG. 4, the front edge of the front base member 20, constituted by the flexible elongate member 24, is hingedly connected at 21 to the lowermost edge of the front panel 14. The rear edge of flexible member 24, also known as the first elongate component, is hingedly connected at 25 to the front lip or page retainer 26, also known as the second elongate component. To be noted is the fact that the rear edge of the second elongate component 26 is hingedly connected at 27 to the front edge of a third elongate component 28. It is to be understood that the elongate components 24, 26 and 28 constitute the front base member 20, with the widths and interrelationships of the elongate components 24 and 26 being of particular consequence to the highly advantageous manner in which my novel easel functions.

The rear edge of the third elongate component 28 is connected at 22 to rear base member 30, with the hinged connection 22 disposed along what may be considered as the central longitudinal axis of the easel. As a consequence of the front base member 20, when considered in a front-to-back direction, having the same width as the rear base member 30, when considered in a front-to-back direction, it is readily possible for the central portion of the underside of the easel to be pushed upwardly, in the manner depicted in FIG. 3*a*, and then folded flat when not in use, as illustrated in FIG. 3*b*. I prefer for the hinge 22 to be constructed so as to bend in a single direction, thus to prevent the base members 20 and 30 from drooping below the positions revealed in FIG. 3, while still readily permitting the base members to be folded upwardly in the manner depicted in FIG. 3*a*.

In one exemplary embodiment, the lengths or lateral dimensions of the front panel 14 and the rear panel 16 were each eighteen inches, whereas the height of each panel, measured from the hinge location 18 down to the lower edge of each panel, was approximately fifteen inches. The distance between the lower edge of the front panel and the lower edge of the rear panel, when the panels have been spread apart to their fullest width as shown in FIG. 3, was approximately eleven inches. To be noted is the fact that in this exemplary embodiment, the hinge connection 22 between the front and rear base members is approximately five and one-half inches from the lower edge of each of the main panels.

It is most important to observe that I am not to be limited to the foregoing exemplary dimensions, for my novel easel could be either larger or smaller than this and still obtain the highly advantageous page retention features made possible by the novel construction of the elongate components constituting the front base member 20, which construction is shortly to be explained in considerable detail.

It should now be clear that the front base member 20 is constituted by the three hingedly connected elongate components best illustrated in FIG. 4, which are the first, second and third elongate components 24, 26 and 28 respectively. Each of these operationally related elongate components will be noted to extend substantially the full length of the front panel 14 (and in many instances the length of the rear panel 16) of the easel, and the importance of the relationships of these components will be hereinafter discussed.

With continuing reference to the embodiment of my invention depicted in FIG. 4 and to the constituents of the front base member 20, it will be apparent that the first elongate component 24 is hingedly attached at 25 to the second elongate component 26, whereas the second elongate component 26 is hingedly attached at 27 to the third elongate component 28. The hinge connections between the first and second elongate components, and between the second and third elongate components permit a wide range of motion, as does the connection at 21.

It is to be noted that the first elongate component 24 of this embodiment, unlike the other elongate components, is of somewhat flexible construction so that it can readily undertake the substantial curvature shown in some detail in FIG. 2. If paper covered or plastic covered cardboard, or plastic covered sheet plastic is used in the construction of the various components and panels of this first embodiment of my novel easel, the first elongate component 24 may be formed, in accordance with this embodiment, of the upper and lower plastic or paper covering; note FIG. 4. It is to be noted that if the front and rear panels and the elongate base components are covered with paper, this paper is of relatively high quality, possessing tear resistance.

At the location of a hinge formed in the manner depicted in FIG. 4 and more particularly, the hinge location 27, it is to be understood that a narrow elongate strip of the relatively rigid material has been removed from between the upper and lower paper or plastic coverings, thus to permit a wide range of motion between the elongate components.

Continuing with embodiment illustrated in FIG. 4, and considering the three elongate components constituting the front base member 20 from the standpoint of their front-to-back dimensions, it is of considerable importance to note that the first (flexible) elongate component 24 is of a lesser width, considered in a direction perpendicular to the length of the front panel 14, than the width of the relatively stiff second elongate component 26. This width difference is of particular consequence to the automatic biasing of the front lip 26 firmly against the pages of the book or booklet 12 in the manner shown in FIGS. 1 and 2, as will hereinafter be explained. On the other hand, the relatively rigid third elongate component 28 needs to be only of a width which, when added to the combined width of the elongate components 24 and 26, will have a total width equal to the width of the rear base member 30.

From the standpoint of length, only the elongate components 24 and 26 need be the full length of the front panel 14, for as previously indicated, the back panel 16 need not be the full length of the front panel, and in a like manner, the third elongate component 28 and the rear base member 30 may be of lesser length in the event that the back panel 16 is of an abbreviated length.

Inasmuch as the interrelationships as well as the relative widths of the first and second elongate components 24 and 26 are of primary importance to this embodiment of my invention, I may at times refer to the base members 28 and 30 as the intermediate base members.

Figure 6A:
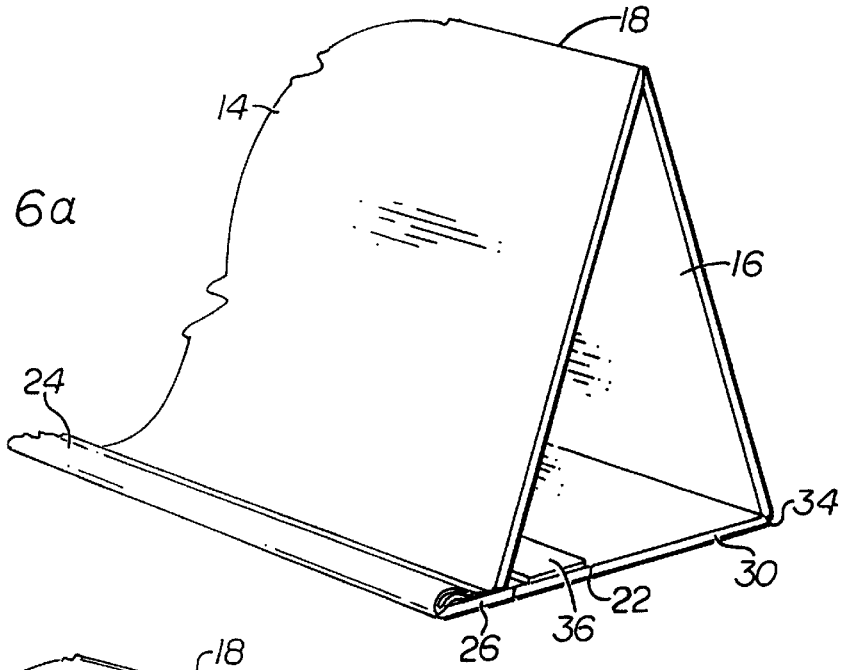
FIG. 6*a* is a fragmentary perspective view from a front corner of my novel easel in which the lower edge of the front panel has been moved a bit rearwardly so as to cause two of the elongate components of the front base member of my novel easel to move into an outwardly-extending, book-receiving position, with this view also revealing the optional use of an elongate stop member positioned to arrest the rearward movement of the lower edge of the front panel member at a desired location.

With regard now to the deployment of this embodiment of my novel easel in a fully operational manner, it is to be realized that the front panel 14, when its lower edge is moved a bit rearwardly from its most outward position illustrated in FIG. 3, causes the first elongate component 24 and the second elongate component 26 to move into an adjacent, substantially coplanar relationship, as clearly shown in FIG. 6*a*. As will be noted from FIG. 6*a*, the first elongate component 24 is caused in this instance to be located directly above the second elongate component 26 and positioned to receive the lower edge of a book or poster placed thereon when the book or poster is leaning against the front panel 14. I will hereinafter refer in some instances to the elongate components 24 and 26 depicted in FIG. 6*a* as being deployed in an outwardly-extending, book-receiving position, and in other instances I may refer to FIG. 6*a* as illustrating a first position of the components 24 and 26.

Figure 6B:
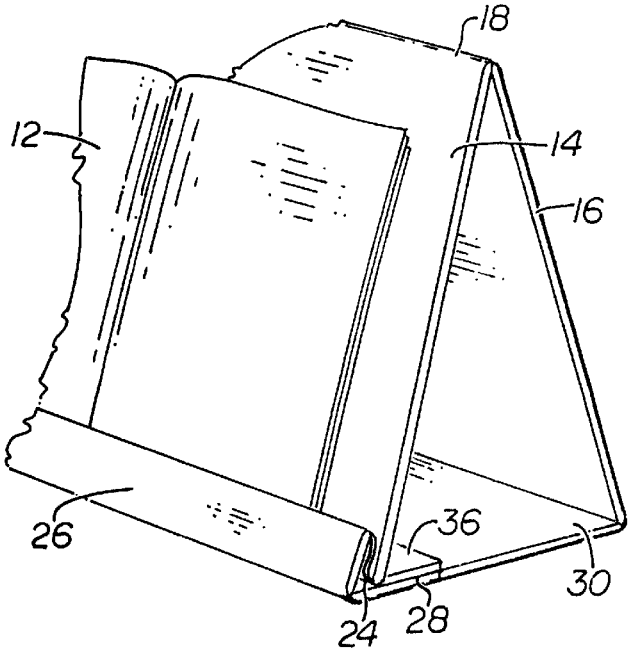
FIG. 6*b* is a perspective view closely related to FIG. 6*a*, but in this instance showing the pair of elongate components of the front base member of my novel easel having been moved upwardly into a stable position in which the pages of a book supported adjacent the front panel are maintained in an easy-to-read manner without necessitating the use of clips, clamps or an encircling band.

I regard the relationship of components depicted in FIG. 6*a* to represent the initial operational position of my novel easel, whereas in FIG. 6*b* I show that as the result of the placement of the book or booklet 12 on the outwardly extended components 24 and 26, and these components moved by the teacher or instructor upwardly into the book-contacting position, the natural bias provided in accordance with this invention will cause the two elongate components 24 and 26 to remain firmly in this book-retaining or second position. The ready movement of the elongate components 24 and 26 between the book-receiving or first position, and the page-retaining or second position is to be regarded as one of the most important aspects of my invention.

It is to be noted that despite the upward movement or rotation of the elongate components 24 and 26 into the position depicted in FIGS. 1 and 6*b*, my novel easel maintains a substantial amount of stability on its support surface at all times, whether or not a book or booklet is being supported on the easel.

It should now be entirely clear that when the book or booklet is being supported, the flexible member 24 utilized in accordance with this embodiment undertakes a definite amount of curvature, with this curvature of the member 24 being shown in a particularly clear manner in FIG. 2.

With continued reference to FIGS. 6*a* and 6*b*, it will be noted that in accordance with a different embodiment of this invention, an elongate stop member 36 is mounted on the member 28, extending the length of this member. The stop member is disposed at a location not interfering with the functioning of the previously mentioned hinge 22. Although not a requisite of my invention, the stop 36 may be utilized in some easel constructions to prevent movement of the lower edge of the front panel 14 in the rearward direction beyond a clearly established point.

It is desirable to return to FIGS. 1 and 2 at this time in order to further consider the importance, in accordance with the primary embodiment of my invention, of the automatic bias of the page retainer 26 into firm contact with the pages of the book or booklet 12. It is to be emphasized that the width of the relatively rigid second elongate component 26 is greater than the width of the flexible, first elongate component 24.

The front panel 14, when its lower edge is moved a bit rearwardly from its spread-apart relationship with the rear panel, causes the first elongate component 24 and the second elongate component 26 to move into an adjacent, substantially coplanar relationship, such that the first elongate component is located above the second elongate component, with the elongate components extending along the lower edge of the front panel 14. It will be recalled that I had previously described the first and second elongate components as being illustrated in an outwardly-extending, book-receiving position in FIG. 6*a*.

It was also earlier mentioned that the first and second elongate components are rotatable between the outwardly-extending, book-receiving position, and an upward or second position in which the elongate components are in essential parallelism with the front panel, as illustrated in FIG. 6*b*.

The first elongate component 24, by virtue of being of lesser width than the second elongate component 26, serves as some support for the lower edge of the front panel 14 during such upward rotation of the pair of elongate components, with the portion of the weight of the front panel borne by the first elongate component contributing to the development of a bias tending to hold the elongate components in firm restraining contact with the lower edge of a book or booklet residing adjacent the front panel.

Inasmuch as in the principal embodiment of my invention the first elongate component 24 is intentionally of flexible construction, it is subject to being deflected somewhat downwardly by the weight of the book or poster, as depicted in FIG. 1, but illustrated in much greater detail in FIG. 2. The downward deflection of the first elongate component 24 enables the somewhat wider second elongate component 26 to then be readily moved "over center," or in other words, past a vertical position and into a rearwardly inclined position in which it resides at an acute angle with respect to the elongate component 28, and in which it is biased into firm restraining contact with the lower edge of the book or poster.

It is important to note that the flexible first elongate component 24, being of less width than the second elongate component 26 and serving to support at least a portion of the weight of the front panel 14, prevents the lower edge of the front panel coming to rest until such time as the second elongate component 26 has moved into an acute angle with the third elongate component 28. This portion of the weight of the front panel on the flexible member 24 may be regarded as furnishing the force serving to bias the second elongate component 26 into firm contact with the book, booklet or poster.

At this time, as a result of the weight of the book or booklet, the lower edge of the front panel 14 moves a bit further in the rearward direction, and in many instances the lower edge may make firm contact with the third elongate component 28, as depicted in FIG. 2. On the other hand, in some instances the book may be of such a width that the lower edge of the front panel does not actually touch the elongate component 28.

Figure 7A:
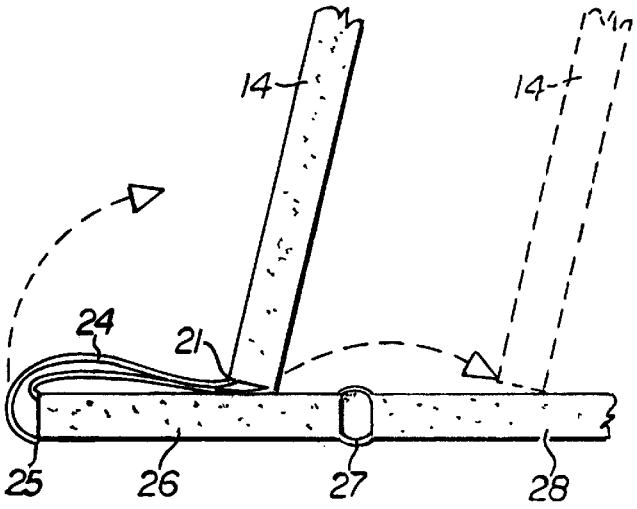
FIG. 7*a* is a fragmentary view to a large scale illustrating how the use of the novel elongate flexible base member hingedly attached to the lower edge of the front panel as well as to the relatively rigid elongate component enables the relatively rigid elongate component to rotate and to bring about a form of lifting action with respect to the front panel of my novel easel, with this action causing the front panel to be moved slightly upwardly and rearwardly in the manner depicted by the curved arrow, with this arrangement of components creating a novel bias causing the relatively rigid elongate component to reside firmly against the pages of an opened book resting against the front panel.
Figure 7B:
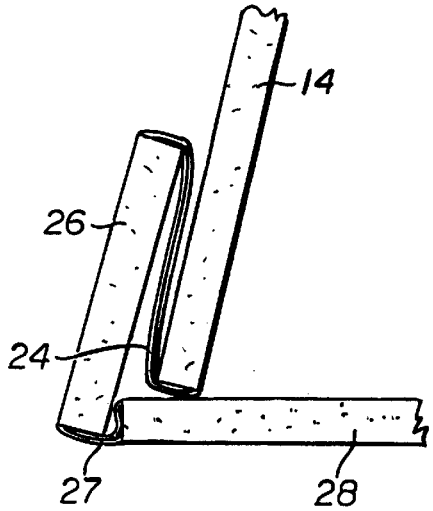
FIG. 7*b* is a fragmentary view also to a large scale illustrating how the relatively rigid elongate component, when it has moved into its raised attitude, assumes a position relatively close to the lower edge of the front panel.

The rearward movement of the front panel 14 is made additionally clear by reference to FIG. 7*a*, where the short, curved arrow represents the lower edge of the front panel 14 "stepping over" the juncture between the relatively rigid elongate members 26 and 28. This action takes place as a consequence of the fact that the elongate component 26 is of greater width than the width of the flexible component 24, with the rotational movement of the member 26 causing, in a manner of speaking, the lower edge of the front panel 14 to be lifted by the flexible component 24 over the juncture between the members 26 and 28, and into a new stable position represented by the dashed lines in FIG. 7*a*. At this point the elongate members 24 and 26 will be biased into essential parallelism with the front panel, as depicted in FIG. 7*b*, and if a book is resting on the front panel, the pages of the book will be firmly held in an easily read position. It may be of some interest to note that at this time the third elongate component 28 is flat and in a coplanar relationship with the rear base member 30.

It is highly important to observe that when the second elongate component or front lip 26 has been moved into its biased, page-restraining position against the book or booklet depicted in FIG. 1, it will, in a novel and highly advantageous manner, remain firmly in that position without the use of magnets, springs or any other external means. Because the second elongate component 26 is of greater width than the flexible first component 24, the movement of the lip-forming components 24 and 26 by the teacher, instructor or other user from the outwardly-extending, book-receiving position of FIG. 6*a*, into the page-retaining position depicted in FIG. 6*b*, will result in these members being biased firmly and stably into the position residing against the book or booklet.

In many instances the weight of the book or booklet actually contributes to the force with which the second elongate component 26 presses against the contacted pages.

It is important to note that my novel design makes it conveniently possible, when the user wishes to turn the page of the book, to easily rotate the first and second elongate components down into the lowered position depicted in FIG. 6*a*, turn the page, and then easily return these two elongate components to the upwardly-biased page-restraining position. This of course is highly advantageous when compared with earlier arrangements requiring the user to temporarily remove an encircling band or release a clip in order to move from one page to the next, and to thereafter restore the band or clip.

It was earlier mentioned that I may utilize any of several different constructional techniques in the creation of the several hinges required in order for my novel easel to function in the intended manner. For example, and with reference back to FIG. 5, my novel easel may be created by the use of an extrusion technique, with the front panel 114, the second elongate component 126, the third elongate component 128 and other parts of the easel created as relatively stiff members as is appropriate. On the other hand, the first elongate component 124, and the hinges 127 and 122 are created during the extrusion procedure so as to be sufficiently flexible as to permit movement of the components 124 and 126 into the book-contacting position previously described in connection with the earlier embodiment.

Figure 8A:
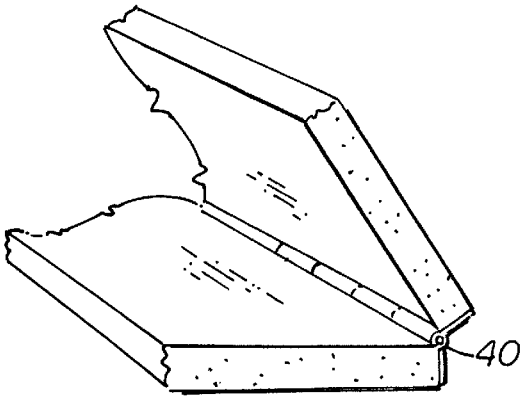
FIG. 8*a* is a fragmentary view revealing an embodiment of my invention in which two of the relatively rigid members may be hingedly connected by the use of an extruded, piano style hinge.

Turning to FIG. 8*a*, this figure reveals that two of the relatively rigid members may be hingedly connected by the use of an extruded, piano style hinge 40.

Figure 8B:
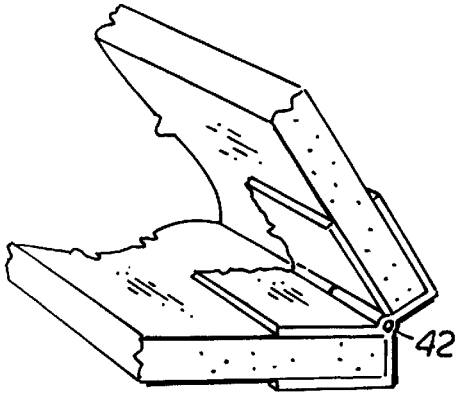
FIG. 8*b* is a fragmentary view revealing another embodiment of an extruded hinge, this being an extruded component created with slots configured to receive a pair of relatively rigid members.

FIG. 8*b* reveals another embodiment of an extruded hinge, this being an extruded component 42 created with slots configured to receive a pair of relatively rigid members, such as, for example, the lower edge of a rear panel and the rear base member of one type of easel embodiment. The relatively rigid members can be glued, cemented or force-fitted into the slots created in these extruded components.

Figure 8C:
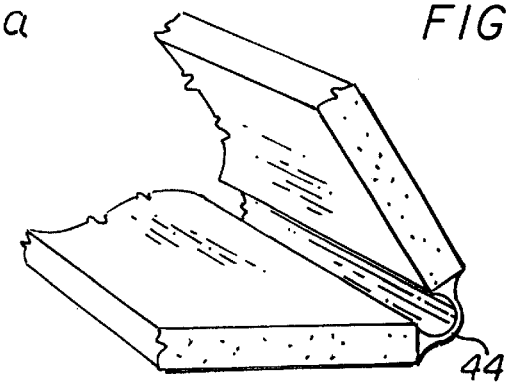
FIG. 8*c* is a fragmentary view revealing how a rear base member and the rear panel of an easel may be hingedly inter connected by the use of an extruded membrane hinge.

FIG. 8*c* reveals the manner in which a rear base member and the rear panel may be hingedly interconnected by the use of an extruded membrane hinge 44.

Figure 9:
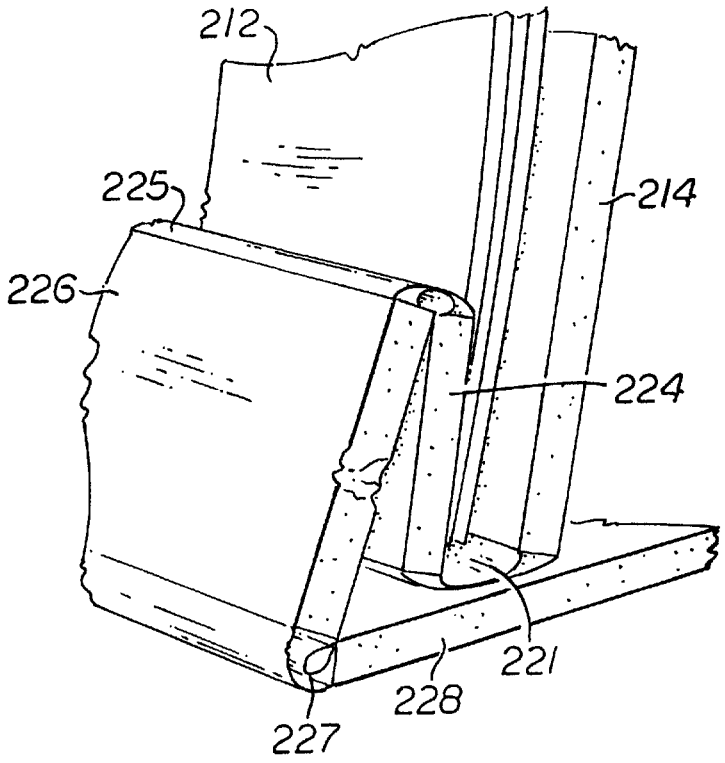
FIG. 9 is a fragmentary view representing an embodiment of my invention involving the first elongate component being of somewhat rigid construction, with the joint between the first elongate component and the lower edge of the front panel being of greater thickness or dimension than was the case with the primary embodiment, thus to enable a book of some thickness to be accommodated.

Turning now to FIG. 9, it is to be seen that this figure represents an embodiment of my invention which in this instance involves the first elongate component 224 being of somewhat rigid construction. This is in contrast with the first elongate component being of flexible construction, as had been described for the elongate component 24 depicted in connection with the primary embodiment. In order that a book 212 of some thickness can be accommodated when the first elongate component 224 is not of flexible construction, FIG. 9 reveals that in this embodiment, the joint 221 between the elongate component 224 and the lower edge of the front panel 214 must be of greater thickness or dimension than was the case with the primary embodiment. The enlarged width or thickness of this hinge-type joint 221 is necessary inasmuch as in order for the elongate components 224 and 226 to be able to be biased into the page-retaining position, these elongate components must be able to move "over center," or in other words, past a vertical position and into a somewhat rearwardly inclined position in which these components are biased into firm restraining contact with the lower edge of a book of rather substantial thickness.

As in the case of the primary embodiment of my invention in which the flexible first elongate component 24 was used, the first elongate component 224 of the embodiment of my invention depicted in FIG. 9 is of less width than the second elongate component 226. From FIG. 9 it can be seen that the first and second elongate components of this embodiment are interconnected by a flexible hinge 225. The first elongate component 224 serves to support at least a portion of the weight of the front panel 214 and prevents the lower edge of the front panel coming to rest until such time as the second elongate component 226 has moved into an acute angle with the third elongate component 228. The combined weight of the front panel 214 and the book 212 on the first elongate component 224 may be regarded as furnishing the force serving to bias the first and second elongate components into firm contact with the book, booklet or poster.

As should now be obvious, unless the joint 221 between the non-flexible elongate component 224 and the lower edge of the front panel 214 is properly enlarged so as to be of somewhat greater thickness or dimension than the book 212, the desired biasing of the elongate components into firm restraining contact with the lower edge of the book or poster cannot take place in the intended manner.

Figure 10:
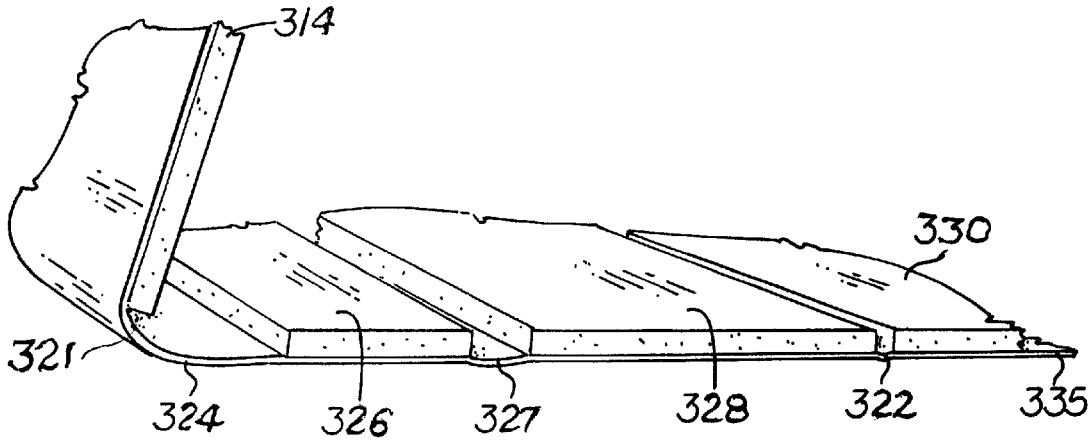
FIG. 10 is a fragmentary view representing an embodiment in which only the exterior or outboard surfaces of the components of the easel are covered with paper or sheet plastic, with this in some instances being advantageous over an arrangement in which dual coverings are used with respect to the base components and the panels utilized in the construction of the easel.

With reference to still another embodiment of my invention, in fragmentary FIG. 10 I reveal an embodiment in which, instead of the elongate cardboard or sheet plastic components of the base members and the front and rear panel members being covered on both sides with tear resistant paper or sheet plastic, only what may be regarded as the lower or outboard surfaces of the elongate base components and the panels are covered with paper or sheet plastic in accordance with this embodiment. In other words, when the design in which a single covering rather than a dual covering is used, the single covering is employed on the outboard or exterior surfaces of the members constituting the easel.

In accordance with the embodiment of FIG. 10, the front panel 314, corresponding to panel 14 of the primary embodiment, is connected at 321 to the member 324, with the texture of the covering material 335 being such that the member 324 may be regarded as analogous to the flexible elongate member 24 of the primary embodiment. The flexible member 324 is connected to the second elongate component 326 of my invention, and by means of hinge 327, formed of the covering material 335, the second elongate member 326 is connected to the third elongate member 328. The hinge 322, also formed of the covering material 335, serves to connect component 328 to the elongate base member 330.

It is thus to be seen that I have provided several embodiments of a novel easel or book stand utilizing a pair of foldable components mounted along the lower edge of the front panel of the easel, in each of which embodiments these components are readily rotatable from an outwardly extending, book receiving position into an upwardly directed position in which these components are automatically biased into a relationship serving to retain the pages of the book in easily read positions, with it to be understood that the user can easily overcome this automatic bias, and move the elongate components away from the page-retaining position when the page of the book is to be turned. Following this, the elongate components may be quickly moved back into the page-retaining position in which the novel, highly effective bias arrangement is automatically restored.

Each of these embodiments will greatly simplify the efforts of a teacher, lecturer or other user desiring to use a book, booklet or poster in connection with his or her presentation, inasmuch as the inherent, unobvious and highly advantageous construction of this novel easel enables the user to be unconcerned with possible slippage of the displayed item, nor fear that the pages will sag into non readable positions.

I am not to be limited to the configurations of the easel embodiments described and illustrated herein, nor to the dimensions and structural materials I have set forth, except as required by the scope of the appended claims.

I claim:

1. An easel primarily for use in the support of a book or booklet, said easel utilizing a front panel operatively associated with a rear panel, with said front panel extending the full lateral length of the easel and being movable into a spread-apart relationship with said rear panel, said front panel having a lower edge, to which an elongate base member is hingedly attached, with said elongate base member involving a plurality of elongate components, including a first elongate component of flexible construction so as to be able to undertake curvature, said first elongate component extending substantially the full lateral length of said front panel, said first elongate component hingedly connected to said lower edge of said front panel as well as to a second elongate component of said elongate base member, with said second elongate component having a slightly greater width than said first elongate component, said front panel, when its lower edge is moved a bit rearwardly from its spread-apart relationship with said rear panel, causing said first and second elongate components to move into an adjacent, substantially coplanar relationship, such that said first elongate component is located above said second elongate component, with said elongate components extending along said lower edge of said front panel, said first and second elongate components being rotatable between an outwardly-extending, book-receiving position, and an upward position in which said first and second elongate components are in essential parallelism with said front panel, said first elongate component, by being of lesser width than said second elongate component, serving as some support for said lower edge of said front panel during such upward rotation of said elongate components, said first elongate component undertaking curvature and being biased into a firm restraining contact with the lower edge of a book or booklet residing adjacent said front panel.

2. The easel primarily for use in the support of a book or booklet as recited in claim 1 in which said first elongate component, because of its flexible construction, is subject, when in its outwardly-extending, book-receiving position, to being deflected somewhat downwardly by the weight of a book or booklet placed thereon, the downward deflection of said first elongate component further aiding said first elongate component being moved into firm restraining contact with the lower edge of the book or booklet residing against said front panel.

3. The easel primarily for use in the support of a book or booklet as recited in claim 1 in which both of said panels and all of the components of said base members are of relatively stiff cardboard covered on at least one side with flexible, tear-resistant paper, with the exception of said first elongate component, which contains no cardboard.

4. The easel primarily for use in the support of a book or booklet as recited in claim 3 in which both of said panels and all of said components of said base members are covered on both sides with flexible, tear resistant paper.

5. The easel primarily for use in the support of a book or booklet as recited in claim 1 in which both of said panels and all of the components of said base members are of relatively stiff cardboard covered on at least one side with flexible plastic, with the exception of said first elongate component, which contains no cardboard.

6. The easel primarily for use in the support of a book or booklet as recited in claim 5 in which both of said panels and all of said components of said base members are covered on both sides with flexible plastic.

7. The easel primarily for use in the support of a book or booklet as recited in claim 1 in which both of said panels and all of the components of said base members are of relatively stiff sheet plastic material covered on at least one side with flexible plastic, with the exception of said first elongate component, which contains no sheet plastic.

8. The easel primarily for use in the support of a book or booklet as recited in claim 7 in which both of said panels and all of said components of said base members are covered on both sides with flexible plastic.

9. The easel primarily for use in the support of a book or booklet as recited in claim 1 in which said front and rear panels and all of the components of said elongate base members are created by extrusion techniques.

10. An easel primarily for use in the support of a book or booklet with the pages of the book or booklet automatically biased into a flat, easily read position, said easel utilizing a front panel operatively associated with a rear panel, with said front panel extending the full lateral length of the easel and being movable into an outward, spread-apart relationship with said rear panel, an elongate base member attached to the lower edge of said front panel, with said elongate base member involving a plurality of elongate components, including a first elongate component of flexible construction and extending substantially the full lateral length of said front panel and hingedly connected to said lower edge of said front panel, said first elongate component hingedly connected to a second elongate component of said elongate base member, with said second elongate component having a slightly greater width than said first elongate component and through an intermediate base member, having a connection with the lower edge of said rear panel, said front panel, when its lower edge is moved a bit rearwardly from its outward position, causing said first and second elongate components to move into an adjacent, substantially coplanar relationship, such that said first elongate component is located above said second elongate component and positioned in an outwardly-extending, book-receiving position along said lower edge of said front panel, said first and second elongate components being rotatable together from such outwardly-extending, book-receiving position, upwardly into a position in general parallelism with said front panel, said first elongate component, by being of lesser width than said second elongate component, serving as some support for said lower edge of said front panel during such upward rotation, with the portion of the weight of said front panel borne by said flexible first elongate component contributing to the development of a bias tending to hold said elongate components in a firm restraining contact with the lower edge of the book or booklet.

11. The easel primarily for use in the support of a book or booklet as recited in claim 10 in which said first elongate component, because of its flexible construction, is subject, when in its outwardly-extending, book-receiving position, to being deflected somewhat downwardly by the weight of a book or booklet placed thereon, the downward deflection of said first elongate component further aiding said elongate components being moved into firm restraining contact with the lower edge of the book or booklet resting against said front panel.

12. The easel primarily for use in the support of a book or booklet as recited in claim 10 in which both of said panels and all of the components of said base members are of relatively stiff cardboard covered on at least one side with flexible, tear-resistant paper, with the exception of said first elongate component, which contains no cardboard.

13. The easel primarily for use in the support of a book or booklet as recited in claim 12 in which both of said panels and all of said components of said base members are covered on both sides with flexible, tear resistant paper.

14. The easel primarily for use in the support of a book or booklet as recited in claim 10 in which both of said panels and all of the components of said base members are of relatively stiff cardboard covered on at least one side with flexible plastic, with the exception of said first elongate component, which contains no cardboard.

15. The easel primarily for use in the support of a book or booklet as recited in claim 14 in which both of said panels and all of said components of said base members are covered on both sides with flexible plastic.

16. The easel primarily for use in the support of a book or booklet as recited in claim 10 in which both of said panels and all of the components of said base members are of relatively stiff sheet plastic material covered on at least one side with flexible plastic, with the exception of said first elongate component, which contains no sheet plastic.

17. The easel primarily for use in the support of a book or booklet as recited in claim 16 in which both of said panels and all of said components of said base members are covered on both sides with flexible plastic.

18. The easel primarily for use in the support of a book or booklet as recited in claim 10 in which both of said panels and all of the components of said elongate base members are created by extrusion techniques.

19. An easel primarily for use in the support of a book or booklet, said easel utilizing front and rear panels whose upper edges are joined together in the manner of a flexible hinge, said front panel extending the full lateral length of the easel and being movable from a folded relationship with said rear panel into a relationship in which the lower edges of said front and rear panels assume a spread apart, outward position, said lower edges of said front and rear panels being interconnected by multiple, folded base members of elongate configuration, said elongate base member attached to said lower edge of said front panel involving a first elongate component extending substantially the full lateral length of said front panel and hingedly connected to said lower edge of said front panel, said first elongate component being of flexible construction and hingedly connected to a second elongate component of said elongate base member, with said second elongate component having a slightly greater width than said first elongate component, said front panel, when its lower edge is moved a bit rearwardly from its outward position, causing said first and second elongate components to move into an adjacent, substantially coplanar relationship, such that said first elongate component is located above said second elongate component and positioned in an outwardly-extending, book-receiving position along said lower edge of said front panel, said first and second elongate components being rotatable together from such book-receiving position, upwardly into a position in general parallelism with said front panel, said first elongate component, by being of lesser width than said second elongate component, serving as some support for said lower edge of said front panel during such upward rotation, with the portion of the weight of said front panel borne by said flexible first elongate component contributing to the development of a bias tending to hold said first and second elongate components in a firm restraining contact with the lower edge of the book or booklet.

20. The easel primarily for use in the support of a book or booklet as recited in claim 19 in which said first elongate component, because of its flexible construction, is subject, when in its outwardly-extending, book-receiving position, to being deflected somewhat downwardly by the weight of a book or booklet placed thereon, the downward deflection of said first elongate component further aiding said elongate components being moved into firm restraining contact with the lower edge of the book or booklet resting against said front panel.

21. The easel primarily for use in the support of a book or booklet as recited in claim 19 in which the separation of the lower edges of said front and rear panels is limited by said multiple, folded base members.

22. The easel primarily for use in the support of a book or booklet as recited in claim 19 in which both of said panels and all of the components of said base members are of lightweight construction.

23. The easel primarily for use in the support of a book or booklet use as recited in claim 19 in which both of said panels and all of the components of said base members are of relatively stiff cardboard covered on at least one side with flexible, tear-resistant paper, with the exception of said first elongate component, which contains no cardboard.

24. The easel primarily for use in the support of a book or booklet as recited in claim 23 in which both of said panels and all of said components of said base members are covered on both sides with flexible, tear resistant paper.

25. The easel primarily for use in the support of a book or booklet as recited in claim 19 in which both of said panels and all of the components of said base members are of relatively stiff cardboard covered on at least one side with flexible plastic, with the exception of said first elongate component, which contains no cardboard.

26. The easel primarily for use in the support of a book or booklet as recited in claim 25 in which both of said panels and all of said components of said base members are covered on both sides with flexible plastic.

27. The easel primarily for use in the support of a book or booklet as recited in claim 19 in which both of said panels and all of the components of said base members are of relatively stiff sheet plastic material covered on at least one side with flexible plastic, with the exception of said first elongate component, which contains no sheet plastic.

28. The easel primarily for in the support of a book or booklet as recited in claim 27 in which both of said panels and all of said components of said base members are covered on both sides with flexible plastic.

29. The easel primarily for use in the support of a book or booklet as recited in claim 19 in which both of said panels and all of the components of said base members are created by extrusion techniques.

30. An easel primarily for use in the support of a book or booklet, said easel principally constructed of flat, generally planar components, said easel utilizing front and rear panels having upper edges joined together in the manner of a flexible hinge, said front panel extending the full lateral length of the easel and being movable between a flattened, touching relationship with said rear panel, and a relationship in which the lower edges of said front and rear panels assume a spread apart, outward position, said lower edges of said front and rear panels being interconnected by multiple, folded base members, including a front base member and a rear base member, said front base member comprising hingedly interconnected first and second elongate components extending substantially the full lateral length of said easel, with said first elongate component hingedly attached to said lower edge of said front panel as well as to said second elongate component, said first elongate component being flexible and of a lesser width, in a direction perpendicular to the lateral length of said front panel, than the width of said second elongate component, said front panel, when its lower edge is moved a bit rearwardly from its most outward position, causing said first and second elongate components to move together into a substantially coplanar, outwardly extending, book-receiving position along the lower edge of said front panel, from which position said first & second components can rotate upwardly into a book-contacting position, so as to be in contact with the lower edge of a book or booklet that has been placed on said elongate components, in contact with said front panel, said first elongate component, because of its attachment to said lower edge of said front panel, serving as some support for said lower edge of said front panel during upward rotation of said elongate components, with the portion of the weight of said front panel borne by said flexible first elongate component causing it to deflect somewhat downwardly, with this contributing to the development of a bias tending to hold said elongate components in a firm restraining contact with the lower edge of the book or booklet when said elongate components have been rotated to their upward position.

31. The easel primarily for use in the support of a book or booklet as recited in claim 30 in which the separation of the lower edges of said front and rear panels is limited by said multiple, folded base members.

32. The easel primarily for use in the support of a book or booklet as recited in claim 30 in which both of said panels and all of the components of said base members are of lightweight construction.

33. The easel primarily for use in the support of a book or booklet as recited in claim 30 in which both of said panels and all of the components of said base members are of relatively stiff cardboard covered on at least one side with tear-resistant, flexible paper, with the exception of said first elongate component, which contains no cardboard.

34. The easel primarily for use in the support of a book or booklet as recited in claim 33 in which both of said panels and all of said components of said base members are covered on both sides with flexible, tear resistant paper.

35. The easel primarily for use in the support of a book or booklet as recited in claim 30 in which both of said panels and all of the components of said base members are of relatively stiff cardboard covered on at least one side with flexible plastic, with the exception of said first elongate component, which contains no cardboard.

36. The easel primarily for use in the support of a book or booklet as recited in claim 35 in which both of said panels and all of said components of said base members are covered on both sides with flexible plastic.

37. The easel primarily for use in the support of a book or booklet as recited in claim 30 in which both of said panels and all of the components of said base members are of relatively stiff sheet plastic material covered on at least one side with flexible plastic, with the exception of said first elongate component, which contains no sheet plastic.

38. The easel primarily for use in the support of a book or booklet as recited in claim 37 in which both of said panels and all of said components of said base members are covered on both sides with flexible plastic.

39. A folding easel primarily for tabletop use in the support of a book or booklet, said easel being constructed of flat, generally planar components, said easel utilizing front and rear panels, with said front panel extending the full lateral length of the easel, said front and rear panels having upper edges joined together in the manner of a flexible hinge, said front and rear panels being movable between a flattened, touching relationship, and a relationship in which the lower edges of said front and rear panels are moved apart into a spread apart, outward position, said lower edges of said front and rear panels being interconnected by multiple, folded base members, including a front base member and a rear base member, the rear edge of said rear base member being hingedly attached to said lower edge of said rear panel, and the front edge of said rear base member being hingedly attached to said front base member, with the hinged attachment of said front and rear base members being located at a point approximately midway between said lower edges of said front and rear panels when in their spread apart relationship, said front base member being constituted by first and second elongate components extending substantially the full lateral length of said easel, with said first elongate component hingedly attached to said lower edge of said front panel as well as to said second elongate component, said first elongate component being of flexible construction and of lesser width, perpendicular to the lateral length of said front panel, than the width of said second elongate component, said front panel, when its lower edge is moved a bit rearwardly from its most outward position, causing said first and second elongate components to move into an adjacent, substantially coplanar relationship, such that said first elongate component is located above said second elongate component and positioned in an outwardly extending, book-receiving position along the lower edge of said front panel, said components being adapted to receive the lower edge of a book or poster placed thereon when a book or poster is in contact with said front panel, said elongate components being movable into an upward position in which said first elongate component is biased into a firm restraining contact with the lower edge of the book or poster resting against said front panel, said first elongate component, because of its flexible construction, when in said outwardly-extending, book-receiving position, being subject to being deflected somewhat downwardly by the weight of the book or poster, such downward deflection serving to increase the bias of said elongate components into the book-restraining position.

40. The folding easel primarily for tabletop use in the support of a book or booklet as recited in claim 39 in which both of said panels and all of the components of said base members are of lightweight, non-metallic construction.

41. The folding easel primarily for tabletop use in the support of a book or booklet as recited in claim 39 in which both of said panels and all of the components of said base members are of relatively stiff cardboard covered on at least one side with flexible, tear-resistant paper, with the exception of said first elongate component, which contains no cardboard.

42. The folding easel primarily for tabletop use in the support of a book or booklet as recited in claim 41 in which both of said panels and all of said components of said base members are covered on both sides with tear resistant paper.

43. The folding easel primarily for tabletop use in the support of a book or booklet as recited in claim 39 in which both of said panels and all of the components of said base members are of relatively stiff cardboard covered on at least one side with flexible plastic, with the exception of said first elongate component, which contains no cardboard.

44. The folding easel primarily for tabletop use in the support of a book or booklet as recited in claim 43 in which both of said panels and all of said components of said base members are covered on both sides with flexible plastic.

45. The folding easel primarily for tabletop use in the support of a book or booklet as recited in claim 39 in which both of said panels and all of the components of said base members are of relatively stiff sheet plastic material covered on at least one side with flexible plastic, with the exception of said first elongate component, which contains no sheet plastic.

46. The folding easel primarily for tabletop use in the support of a book or booklet as recited in claim 45 in which both of said panels and all of said components of said base members are covered on both sides with flexible plastic.

47. An easel primarily for use in the support of a book or booklet, said easel principally constructed of flat, generally planar components, said easel utilizing front and rear panels having upper edges joined together in the manner of a flexible hinge, said front panel extending the full lateral length of the easel and being movable between a flattened, touching relationship with said rear panel, and a relationship in which the lower edges of said front and rear panels assume a spread apart, outward position, said lower edges of said front and rear panels being interconnected by multiple, folded base members, including a front base member and a rear base member, said front base member comprising hingedly interconnected first and second elongate components extending substantially the full lateral length of said easel, with said first elongate component being of lesser width than said second elongate component, said first elongate component being of non-flexible construction and hingedly attached to said lower edge of said front panel as well as to said second elongate component, the hinged attachment between said first elongate component and the lower edge of said front panel being of substantial width, so as to be able to accommodate a book of substantial thickness, said front panel, when its lower edge is moved a bit rearwardly from its most outward position, causing said first and second elongate components to move together into a substantially coplanar, outwardly extending, book-receiving position along the lower edge of said front panel, from which position said first & second components can rotate upwardly into a book-contacting position, so as to be in contact with the lower edge of a book that has been placed on said elongate components, in contact with said front panel, said first elongate component, because of its attachment to said lower edge of said front panel, serving as some support for said lower edge of said front panel during upward rotation of said elongate components, with the portion of the weight of said front panel borne by said first elongate component contributing to the development of a bias tending to hold said elongate components in a firm restraining contact with the lower edge of the book when said elongate components have been rotated to their upward position.

* * * * *